United States Patent [19]

Cudmore

[11] 4,432,298

[45] Feb. 21, 1984

[54] HYDROFOIL SAILING CRAFT

[76] Inventor: Patrick J. Cudmore, Box 1243, Duxbury, Mass. 02332

[21] Appl. No.: 307,548

[22] Filed: Oct. 1, 1981

[51] Int. Cl.[3] ..... B63B 35/00

[52] U.S. Cl. ..... 114/39; 114/103; 114/274

[58] Field of Search ..... 114/39, 102, 103, 104, 114/271, 274, 275, 276, 278

[56] References Cited

U.S. PATENT DOCUMENTS

| | | | |
|---|---|---|---|
| 2,341,159 | 2/1944 | Neklutin | 114/274 |
| 2,484,687 | 10/1949 | Carl | 114/39 |
| 2,703,063 | 3/1955 | Gilruth | 114/39 |
| 2,767,678 | 10/1956 | Vertens | 114/274 |
| 2,917,016 | 12/1959 | Schertel | 114/274 |
| 3,373,710 | 3/1968 | Steinberg | 114/39 |

FOREIGN PATENT DOCUMENTS

| | | | |
|---|---|---|---|
| 198649 | 5/1924 | United Kingdom | 114/39 |

*Primary Examiner*—Trygve M. Blix
*Assistant Examiner*—Jesus D. Sotelo
*Attorney, Agent, or Firm*—Thompson, Birch, Gauthier & Samuels

[57] ABSTRACT

A hydrofoil sailboat comprises forward and aft surface piercing hydrofoils and an asymmetrical wingsail. Both hydrofoils have an inverted arch configuration and have a cross-section which is approximately a circular segment. The wingsail has a reversible asymetry, is carried on a cantilevered rotatable mast and includes a sail sock that is highly tensioned between a single top frame member and a bisectional articulated bottom frame member, the asymmetry of the wingsail being defined by the relative position of the bottom frame member sections.

10 Claims, 5 Drawing Figures

HYDROFOIL SAILING CRAFT

BACKGROUND OF THE INVENTION

1. Field of the Invention

The present invention relates to sailing craft and, more particularly, is directed towards hydrofoil sailboats having wingsails.

2. Description of the Prior Art

Over the years, there has been a continuous effort to increase the performance characteristics of sailing craft. Early sailboats were limited to sailing in a generally downwind direction. The capability to sail in a generally upwind direction increased with the slow evolution of hull, sail and rigging designs. With the advent of tacking sailboats, it became possible to travel at right angles to the wind or even in a slightly upwind direction. However, tacking sailboats required means for resisting the leeward drift and overturning moment which resulted from the sideward component of the force generated by the sail.

Several attempts have been made to improve sailboat design in the areas of speed potential and the ability to proceed in the windward direction. Hydrofoils have been used to raise the hull out of the water, greatly reducing hydrodynamic drag while still resisting leeward drift. Various hydrofoil configurations have been developed in order to increase speed and improve stability using either fully submerged or inclined surface piercing hydrofoils. However, such designs have had excessive low speed drag and have required high winds and high speeds to lift the hull free of the water. At higher speeds, most hydrofoil sailboats are plagued by air ventilation of the forward leeward hydrofoil which causes the hydrofoil to lose lift and suddenly submerge, resulting in a pitchpoling capsize.

Improvements in the capability of a sailboat to sail more directly into the wind came with the use of wingsails and rigid wings that employ more efficient airfoil shapes. Also, various non-vertical sails have been developed to reduce the overturning moment, such as the type shown in U.S. Pat. No. 3,295,487. Wingsails and rigid wings develop lift at lower angles of attack than a conventional bermudian sail can, and enable the sailboat to point up to 13° closer to the wind. Symmetrical airfoil shapes are fixed and simple but develop about 10% less lift than a bermudian sail of the same size. Asymmetrical airfoil shapes can develop up to 50% more lift than a bermudian sail of the same size, but their asymmetry must be reversed when the sailboat tacks or reverses direction, and the mechanisms that have been developed to do this have been complex and heavy. Over the past several years, improvements have been made in the performance characteristics of hydrofoil sailboats. However, hydrofoil sailboats have met with varying degrees of success because of disadvantages relating to control, stability, and aero/hydrodynamic efficiency.

SUMMARY OF THE INVENTION

It is an object of the present invention to provide a hydrofoil sailboat which does not suffer from the heretofore mentioned disadvantages.

It is another object of the present invention to provide a high speed hydrofoil sailboat with improved performance characteristics. The hydrofoil sailboat of the present invention comprises forward and aft surface piercing hydrofoils and an asymmetrical wingsail. Both hydrofoils have an inverted arch configuration, have a cross-section which is approximately a circular segment (i.e. an arc bounded by a chord), have high aspect ratios (span$^2$/area) and are interconnected by means of deck plates and hull tubes. The wingsail has a single rigid symmetrical top frame member and an asymmetrical bisectional articulated bottom frame member. The bottom frame member has a pair of symmetrical sections that are constrained for limited relative movement with respect to one another. A sail sock is highly tensioned between the top and bottom frames, the forward section of the bottom frame member being movable relative to the sail sock. The wingsail is carried on a center mast which is cantilevered and rotatable.

Other objects of the present invention will in part be obvious and will in part appear hereinafter.

The invention accordingly comprises the sailing craft, together with its parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DESCRIPTION OF THE PREFERRED EMBODIMENTS

Figure 1:
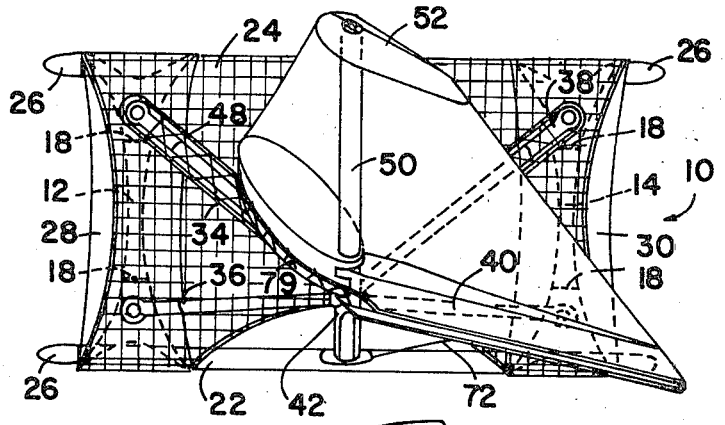
FIG. 1 is a top plan view of a hydrofoil sailboat embodying the present invention.
Figure 2:
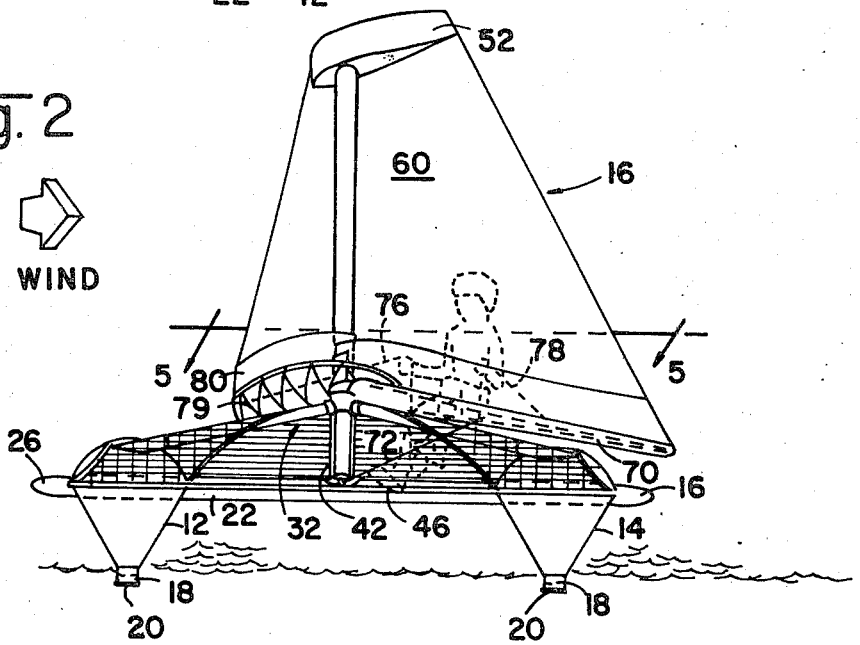
FIG. 2 is a side elevation of FIG. 1.
Figure 3:
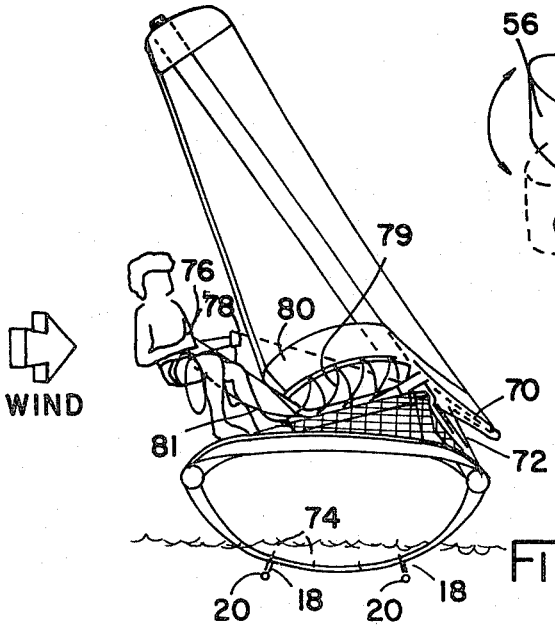
FIG. 3 is a front view of FIG. 1.

Referring now to the drawings, particularly FIGS. 1, 2 and 3, there is shown a hydrofoil sailboat 10, for example a Proa (a boat which sails equally well in the forward and backward directions), having a forward hydrofoil 12, an aft hydrofoil 14 and a wingsail 16 that is raked to windward. Hydrofoils 12 and 14 have a circular segment cross-section with sharp leading and trailing edges so that the foils work equally well in either direction. Each hydrofoil 12 and 14, is a surface piercing, high aspect ratio hydrofoil having a substantially U-shaped or inverted arch profile. The bottom surface of each hydrofoil 12 and 14 is fitted with a pair of skegs 18 that provide centerboard side lift at high speeds, the skegs having a substantially asymmetrical profile as viewed in FIG. 1. Skegs 18 are widely spaced and sized so that when the boat is heeled, the skeg remaining in the water provides adequate windward lift. Tip plates 20, which are provided at the bottom of each skeg 18, increase the efficiency of the skegs, protect the tip of the skegs and function as crude skids for beaching.

Hydrofoils 12 and 14 are interconnected by hull members 22 and 24 which are disposed in spaced parallel relationship. Each hull member 22, 24, for example a section of thin-walled aluminum tubing, is sealed by an end cap 26 such as a streamlined fiberglass cap or plastic bumper. A deck plate 28 is connected to the ends of hydrofoil 12 and hull tubes 22 and 24. A deck plate 30 is connected between the ends of hydrofoil 14 and hull tubes 22 and 24. In the preferred embodiment, hydrofoils 12, 14 and deck plates 28, 30 are composed of fiberglass and are formed to wrap about hull tubes 22, 24 and are connected thereto with rivets, for example. Hydrofoil 12 and deck plate 28, and hydrofoil 14 and deck plate 30 have similar configurations and are interchangeable.

Wingsail 16 is mounted to deck plates 28, 30 and leeward hull tube 22 by a frame 32 and a mast bracket 42. Frame 32, for example a rigid tetrahedral frame, includes braces 34, 36, 38 and 40. One end of each brace 34, 36 is mounted to deck plate 28 and the other ends of these braces are attached to mast bracket 42. One end of each brace 38, 40 is mounted to deck plate 30, and the other ends of these braces are connected to mast bracket 42. The lower end of mast bracket 42 is connected to leeward hull tube 22. A deck 44, for example a lightweight polypropylene material, is stretched across tetrahedral frame 32 and forms an inclined deck for a sailboat operator. Deck 44 is secured to hull tubes 22 and 24 by strips 46, for example bumper strips that are fastened to the hull tubes. In addition, deck 44 is secured by means of laces 48 that are strung to braces 34, 36, 38 and 40. As hereinafter described, wingsail 16 is carried on a mast 50 which is rotatably mounted on mast bracket 42.

Figure 4:
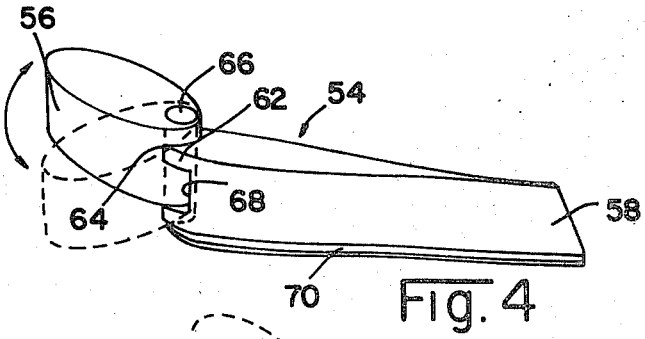
FIG. 4 is a perspective view of the bisectional bottom frame of the wingsail of FIG. 1.

Wingsail 16 is an asymmetrical airfoil having a span of approximately eleven to twelve feet and includes a single top frame 52 and an articulated bisectional bottom frame 54. Frames 52 and 54 are carried on mast 50, for example a fourteen foot unstayed, freely rotating, seven inch diameter aluminum mast. As best shown in FIG. 4, articulated bottom frame 54 includes a forward section 56 and a rearward section 58. In the illustrated embodiment, by way of example, top frame 52 and bottom frame 54 are hollow and sealed for buoyancy and are composed of fiberglass. A sail sock 60, which is composed of a resilient material such as that sold by E. I. du Pont de Nemours & Co. under the trademark Dacron, is highly tensioned between top frame 52 and bottom frame 54. Top frame 52 is keyed to mast 50. Bottom frame sections 56 and 58 are freely hinged about the mast and are rotatable 30° out of plane to produce the desired asymmetry for wingsail 16. Bottom frame sections 56 and 58 are cantilevered off mast 50, section 58 having a boom vang 72 to ease the cantilever loads. As shown in FIG. 4, rearward section 58 is cut away to form forward tongues 62 that are freely received within cutaway sections 64 that are formed in forward section 56. A through hole 66, which is sized to freely receive mast 50, is formed in a rearward portion of forward section 56 at cutaway sections 64 and in tongues 62 of rearward section 58, the forward and rearward sections being constrained for limited pivotal movement about the mast. It will be noted that rearward section 58 is formed with a substantially accurate cutaway portion 68 so that forward section 56 and rearward section 58 are rotatable with respect to one another. Mast 50 is received within mast bracket 42 and is free to rotate therein. In order to keep the aerodynamic center of lift directly over the hydrodynamic center of drag of sailboat 10 when the boat is sailing level, mast 50 is raked to windward, for example at a 36° rake. Because wingsail 16 is raked, useful vertical lift is typically generated which reduces the apparent payload of the sailboat and also reduces hydrodynamic drag. Wingsail 16 is balanced so as not to produce high torque or pitch forces. In addition, the wingsail is rotated just forward of its aerodynamic center of lift which is back from the leading edge of forward section 56 approximately one-third the length of bottom frame 54 so that wingsail 16 will feather when unattended.

Figure 5:
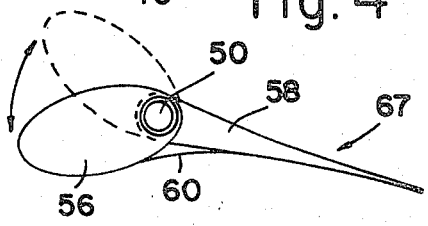
FIG. 5 is a cross-sectional view taken along the line 5—5 in FIG. 2.

As best shown in FIG. 5, wingsail 16 is a thick nosed asymmetrical airfoil with a slightly concave back surface 67 on the pressure side of the airfoil. Though other airfoil section shapes can be used, this preferred airfoil shape produces relatively high lift and low drag, even at very low angles of attack. In the illustrated embodiment, top frame member 52 has a symmetrical airfoil shape with a relatively small chord. As previously indicated, top frame 52 is keyed to rotate with mast 50 which is mounted for rotation in mast bracket 42. Sections 56 and 58 of bottom frame 54 are symmetrical members which are freely hinged about mast 50, the sections being rotatable out of plane on each side to produce the desired asymmetry of wingsail 16. Sail sock 60 is highly tensioned over top frame 52 and is fixed to rearward section 58 of bottom frame 54. Although sail sock 60 is kept under high tension, the sail sock is free to rotate around the front part of forward section 56 of bottom frame 54. The tension on the sliding portion 80 of sail sock 60 is maintained by bottom lacing 79 which freely slides on the rounded bottom portion of the forward frame section 56. It is in this way that wingsail 16 is articulated. Because bottom frame 54 has a relatively large chord, its asymmetrical shape influences the shape of wingsail 16 except at the very top. To minimize the drag that is induced by creation of tip vortices, there is provided a boom tip plate 70 and the elliptically shaped top frame 52. Boom tip plate 70 inhibits air flow from the pressure side to the suction side of wingsail 16. Top frame 52 defines an elliptically shaped wing tip that creates the least induced drag. The use of boom tip plate 70 and elliptical top frame 52 increases the apparent aspect ratio of wingsail 16 and therefore reduces the overall amount of induced drag.

The performance characteristics of sailboat 10 are such that a buoyant mode is experienced from 0–3.5 knots, a hydrodynamic mode from 3.5–14 knots and a hydroplaning mode from 14–35 knots. Winds of at least 6 knots are required to achieve hydrodynamic lift-out. The design of sailboat 10 is such that, as speed increases, hydrofoils 12 and 14 lift the sailboat further above the water, and an increasing proportion of the hydrofoils' lift is generated by hydroplaning pressure on the bottom side of each hydrofoil. Even if, at high speeds, the suction or top sides of hydrofoils 12 and 14 ventilate and lose hydrodynamic lift there is enough residual hydroplaning lift to sustain pitch stability. For example, at 27 knots, hydroplaning lift is approximately 80% of the total lift. Fences or air gates 74 are provided on the suction side of each hydrofoil 12, 14 in order to minimize ventilation. In the illustrated embodiment, each hydrofoil 12 and 14 has a shallow curve so that a large foil area remains submerged even at small depths of submersion. The geometric configuration of each hydrofoil 12 and 14, is such that the cross-sectional area gradually increases from the bottom to the top of the hydrofoil. That is, the hydrofoil buoyancy, chord length and cross-sectional area increase from the center toward the ends of the hydrofoil. This geometric configuration of hydrofoils 12 and 14 produces an increasingly strong righting moment as the hydrofoils are rolled or pitched, giving sailboat 10 dynamic stability in pitch and roll. The operator controls yaw (direction of travel) in sailboat 10 by varying the angle of roll through changes in body position and/or changes in the angle of attack of wingsail 16. As each hydrofoil 12, 14 approaches the free water surface, the surface proximity effect reduces lift and drag about 50%, and a large foil area is required to compensate for the reduction in lift. Lift-producing angles of attack range from −4° to about 15°, but the most efficient range is 0° to 5°, and 1° to 2° is optimal. At lower speeds, the inverted arch configuration of hydrofoils 12 and 14 is similar to a conventional surface piercing "V" configuration in that it produces centerboard side forces to counteract sail-induced side forces. This effect is lost at higher speeds, however, because the submerged portion of hydrofoils 12 and 14 is almost flat and horizontal. Skegs 18 provide centerboard side lift at high speeds.

Sailboat 10 is controlled by a pair of reins 76, 78 that are attached on each side of the wingsail at the forward and rearward ends of bottom frame 74. Sailboat 10 is preferably sailed with the operator in a standing position partially supported by a trapeze 81, as shown in FIG. 3. Peak performance requires that sailboat 10 be sailed pitched up at a constant 2° angle of attack and that wingsail 16 be appropriately angled to the apparent wind. Sailboat 10 is a roll-controlled Proa and can be sailed in either direction. When sailboat 10 is kept level, as shown in FIG. 3, it will sail straight. When sailboat 10 is rolled to one side, the center of lift of wingsail 10 moves further toward that side than does the center of drag of hydrofoils 12 and 14, causing the sailboat to yaw and turn in a direction opposite the direction of roll. At sailboat speeds in excess of approximately 3.5 knots, a roll to windward brings the sailboat 10 off the wind and a roll to leeward brings the sailboat into the wind. When one hull tube is in the water at sailboat speeds of less than approximately 3.5 knots, the roll control procedure is reversed. A roll to windward brings the sailboat 10 into the wind and a roll to leeward brings the sailboat off the wind. By manipulating reins 76 and 78, the operator is able to change the direction of wingsail 16. In addition, when the direction of sailboat 10 is reversed, the operator is also able to reverse the asymmetry of the wingsail from one side to the other. The direction of sailboat 10 is most easily reversed when the course of the sailboat is brought perpendicular to the true wind, and wingsail 16 is feathered to slow down the forward motion of sailboat. The operator then releases the wingsail control reins 76 and 78 on one side of wingsail 16, moves to the opposite end of sailboat 10, picks up the control reins on the other side of the wingsail, pulls the reins taut to reverse the asymmetry of the wingsail, and sails away in the opposite direction. When sailboat 10 is traveling in one direction, hydrofoil 12 is the forward hydrofoil and hydrofoil 14 is the aft hydrofoil. When sailboat 10 is traveling in a reverse direction, hydrofoil 14 is the forward hydrofoil and hydrofoil 12 is the aft hydrofoil. Since mast 50 is free to rotate within bracket 42, the operator can readily change the direction of wingsail 16. In addition, the operator can reverse the asymmetry of wingsail 16 and change the pressure and suction sides of the wingsail by varying the relative positions of forward section 56 and rearward section 58 of bottom frame 54.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A rudderless, bidirectionally sailable, hydrofoil sailing craft comprising:

(a) substantially identical first and second, laterally extending, parallel, high aspect ratio, surface-piercing, buoyant hydrofoils, each said hydrofoil having a continuously curved inverted arch configuration, each said hydrofoil having similar streamlined longitudinal edges and a longitudinally extending cross-section which is symmetrical relative to a vertical laterally extending plane, each said hydrofoil having a zero degree angle of attack;

(b) at least two laterally spaced-apart skegs extending downwardly from the convex lower surface of each said hydrofoil, each said skeg acting as a centerboard to resist sideslip;

(c) means for interconnecting and supporting said first and second hydrofoils in a parallel, longitudinally aligned, vertically level relationship;

(d) a mast mounted at its lower end to said interconnecting means at a location which is midway between said first and second hydrofoils and which is laterally offset to the leeward side relative to the longitudinal centerline of said sailing craft, said mast extending upwardly and laterally at an acute angle not exceeding 80° relative to the horizontal, the upper end of said mast being laterally aligned with said lower end of said mast, said mast upper end being laterally offset to the windward side relative to the longitudinal centerline of said sailing craft; and (e) an upper sail frame carried adjacent said mast upper end, an articulated lower sail frame having a relatively small leading member and a relatively large trailing member carried adjacent said mast lower end, a sail supported by said upper and lower sail frames, and control means for pivotally repositioning said sail frames about the mast axis, and for pivotally repositioning said leading and trailing lower sail frame members relative to each other about the mast axis, said sailing craft sailing equally well in both directions under the influence of hydrofoil buoyant lift at low speeds, hydrofoil upper surface hydrodynamic lift at medium speeds, hydrofoil lower surface hydroplaning lift at higher speeds, and increasing canted sail lift at increasing speeds.

2. The sailing craft as claimed in claim 1 wherein rolling said craft about its longitudinal axis causes the direction of travel of said craft to be altered.

3. The sailing craft as claimed in claim 2 wherein when said craft is rolled in one direction, the center of aerodynamic lift of said craft moves further in that direction than does the center of hydrodynamic drag of said craft.

4. The sailing craft of claim 1 wherein said skegs are positioned on each said hydrofoil so as to be laterally symmetrical relative to the longitudinal centerline of said sailing craft.

5. The sailing craft of claim 1 wherein said interconnecting means includes two parallel, longitudinally extending hull tubes, said tubes being affixed near their ends to the upper ends of said parallel, laterally extending hydrofoils thereby forming an approximate rectangle when viewed in plan.

6. The sailing craft of claim 5 wherein decking material is affixed to and extends between said hull tubes to provide a deck which is entirely unobstructed on its windward side and which is mostly unobstructed on its leeward side of the longitudinal centerline.

7. The sailing craft of claim 5 wherein said mast is angled at approximately 50° to 60° relative to the horizontal, the location of said lower mast end is approximately on said leeward hull tube, and the location of said upper mast end is approximately vertically over said windward hull tube.

8. The sailing craft of claim 1 wherein a plurality of laterally spaced-apart fences are affixed to and extend upwardly from the concave upper surface of each said hydrofoil, said fences acting to minimize ventilation and acting as centerboards.

9. The sailing craft of claim 1 wherein said mast is rotatable in its mounting location, said upper sail frame is fixed to said mast upper end, and said lower sail frame members are independently pivotally connected adjacent to said mast lower end, said control means selectably repositioning said upper and lower sail frame members to cause said sail to assume various asymmetrical airfoil shapes.

10. The sailing craft of claim 1 wherein each said hydrofoil has its shortest longitudinal dimension at the longitudinal centerline, and has its longest longitudinal dimension at its lateral ends, said sailing craft thereby having inherent dynamic roll stability.

* * * * *